US010648662B2

(12) United States Patent
Maitani et al.

(10) Patent No.: US 10,648,662 B2
(45) Date of Patent: May 12, 2020

(54) NOZZLE STRUCTURE FOR HYDROGEN GAS BURNER APPARATUS

(71) Applicants: TOYOTA JIDOSHA KABUSHIKI KAISHA, Aichi-ken (JP); CHUGAI RO CO., LTD., Osaka-shi, Osaka (JP)

(72) Inventors: Nozomi Maitani, Toyota (JP); Daisuke Sakuma, Nagoya (JP); Koichi Hirata, Nisshin (JP); Noriyuki Ueno, Toyota (JP)

(73) Assignees: TOYOTA JIDOSHA KABUSHIKI KAISHA, Toyota-shi, Aichi-ken (JP); CHUGAI RO CO., LTD., Osaka-shi, Osaka (JP)

( * ) Notice: Subject to any disclaimer, the term of this patent is extended or adjusted under 35 U.S.C. 154(b) by 0 days.

(21) Appl. No.: 16/059,163

(22) Filed: Aug. 9, 2018

(65) Prior Publication Data

US 2019/0072274 A1 Mar. 7, 2019

(30) Foreign Application Priority Data

Sep. 4, 2017 (JP) ..... 2017-169474

(51) Int. Cl.
*F23D 14/22* (2006.01)
*F23D 14/74* (2006.01)
(Continued)

(52) U.S. Cl.
CPC ..... *F23D 14/583* (2013.01); *F23C 3/002* (2013.01); *F23D 14/12* (2013.01); *F23D 14/22* (2013.01);
(Continued)

(58) Field of Classification Search
CPC ..... F23D 14/22; F23D 14/74; F23D 14/12; F23C 3/002
(Continued)

(56) References Cited

U.S. PATENT DOCUMENTS 5,692,891 A * 12/1997 Chow ..... F23D 14/58 431/354
5,997,595 A * 12/1999 Yokohama ..... C10J 3/487 239/399
(Continued)

FOREIGN PATENT DOCUMENTS

JP S47-29934 U 12/1972
JP S60-128128 U 8/1985
(Continued)

*Primary Examiner* — Gregory L Huson
*Assistant Examiner* — Nikhil P Mashruwala
(74) *Attorney, Agent, or Firm* — Sughrue Mion, PLLC

(57) ABSTRACT

The present disclosure provides a nozzle structure for a hydrogen gas burner apparatus, capable of reducing an amount of generated NOx. A nozzle structure for a hydrogen gas burner apparatus, includes an outer pipe, an inner pipe disposed concentrically with the outer pipe, and a stabilizer configured to throttle a space between the outer pipe and the inner pipe. The inner pipe includes an inner pipe end part with an axial opening hole and a circumferential opening hole formed therein, the axial opening hole penetrating in an axial direction of the inner pipe, the circumferential opening hole penetrating in a radial direction of the inner pipe. A hydrogen gas flows through the inner pipe. The circumferential opening hole lets the hydrogen gas flow out from the inner pipe in the radial direction of the inner pipe.

2 Claims, 7 Drawing Sheets

(51) Int. Cl.

| | |
|---|---|
| ***F23C 3/00*** | (2006.01) |
| ***F23D 14/12*** | (2006.01) |
| ***F23D 14/58*** | (2006.01) |
| ***F23D 14/48*** | (2006.01) |

(52) U.S. Cl.
CPC ..... *F23D 14/48* (2013.01); *F23D 14/74* (2013.01); *F23C 2900/9901* (2013.01); *F23D 2203/1012* (2013.01); *F23D 2212/10* (2013.01)

(58) Field of Classification Search
USPC ..... 431/131
See application file for complete search history.

(56) References Cited

U.S. PATENT DOCUMENTS

| | | | | |
|---|---|---|---|---|
| 6,682,339 | B2 * | 1/2004 | Cho | F23D 14/22 431/187 |
| 8,070,480 | B2 * | 12/2011 | Potgieter | F23D 11/446 431/12 |
| 2009/0220899 | A1 * | 9/2009 | Spangelo | F23D 14/22 431/8 |
| 2010/0159410 | A1 * | 6/2010 | Hwang | F23D 14/02 431/354 |
| 2010/0323311 | A1 * | 12/2010 | Yoshida | C03B 19/1423 431/187 |
| 2018/0156451 | A1 * | 6/2018 | Hirata | F23C 6/045 |

FOREIGN PATENT DOCUMENTS

| | | |
|---|---|---|
| JP | H4-73718 U | 6/1992 |
| JP | 11-201417 A | 7/1999 |

* cited by examiner

NOZZLE STRUCTURE FOR HYDROGEN GAS BURNER APPARATUS

CROSS REFERENCE TO RELATED APPLICATIONS

This application is based upon and claims the benefit of priority from Japanese patent application No. 2017-169474, filed on Sep. 4, 2017, the disclosure of which is incorporated herein in its entirety by reference.

BACKGROUND

The present disclosure relates to a nozzle structure for a hydrogen gas burner apparatus.

Japanese Unexamined Patent Application Publication No. H11-201417 discloses a nozzle structure for a burner in which a combustion gas is premixed with air, so that generation of NOx is suppressed. In such nozzle structures for burners, hydrocarbon gases and the like are often used as combustion gases.

SUMMARY

The present inventors have found the following problem. It should be noted that there are cases where a hydrogen gas is used as a fuel gas. In such cases, since a hydrogen gas is highly reactive compared to a hydrocarbon gas, a temperature of a combustion flame could become locally high. As a result, a large amount of NOx is sometimes generated.

The present disclosure has been made to reduce an amount of generated NOx in a hydrogen gas burner apparatus.

A first exemplary aspect is a nozzle structure for a hydrogen gas burner apparatus, including an outer pipe, an inner pipe disposed concentrically with the outer pipe, and a stabilizer configured to throttle a space between the outer pipe and the inner pipe, in which the inner pipe includes an inner pipe end part with an axial opening hole and a circumferential opening hole formed therein, the axial opening hole penetrating in an axial direction of the inner pipe, the circumferential opening hole penetrating in a radial direction of the inner pipe, a hydrogen gas flows through the inner pipe, the circumferential opening hole lets the hydrogen gas flow out from the inner pipe in the radial direction of the inner pipe, the axial opening hole lets hydrogen gas flow out from the inner pipe in the axial direction of the inner pipe, an oxygen-containing gas flows between the outer pipe and the stabilizer, a ratio S2/S1 between a cross-sectional area S1 of the axial opening hole and a cross-sectional area S2 of the circumferential opening hole is equal to or lower than 50%, and a ratio S3/S4 between a cross-sectional area S4 of a space between the inner pipe and the outer pipe and a cross-sectional area S3 of a space between an outer edge of the stabilizer and the outer pipe is equal to or lower than 45%.

According to the above-described configuration, a straight-flowing property of the hydrogen gas is ensured by defining an upper limit for the ratio S2/S1. Further, the mixture of the hydrogen gas and the oxygen-containing gas is prevented from advancing by defining an upper limit for the ratio S3/S4. As a result, it is possible to prevent the temperature of the combustion flame from becoming locally high and thereby to reduce the amount of generated NOx.

Further, it may be specified that the ratio S2/S1 and the ratio S3/S4 satisfy the following relation:

$$S3/S4 \leq 0.0179 \times (S2/S1)^2 - 1.7193 \times (S2/S1) + 45.$$

According to the above-described configuration, since ranges of the ratios S2/S1 and S3/S4 are further limited, the mixture of the hydrogen gas and the oxygen-containing gas is further prevented from advancing. Therefore, it is possible to further prevent the temperature of the combustion flame from becoming locally high and thereby to further reduce the amount of generated NOx.

The present disclosure can reduce an amount of generated NOx in a hydrogen gas burner apparatus.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

The present inventors have paid attention to a phenomenon that a level of mixing of a hydrogen gas and an oxygen-containing gas affects an amount of generated NOx (nitrogen oxides). Further, in order to reduce the amount of generated NOx, the present inventors have examined flows of the hydrogen gas and the oxygen-containing gas and conceived that the mixing of the hydrogen gas and the oxygen-containing gas should be controlled. Then, the present inventors have diligently and repeatedly studied the shape, the size, etc. of the nozzle structure, and have achieved the present disclosure.

Specific embodiments to which the present disclosure is applied are explained hereinafter in detail with reference to the drawings. However, the present disclosure is not limited to embodiments shown below. Further, the following descriptions and the drawings are simplified as appropriate for clarifying the explanation. A right-handed three-dimensional xyz-coordinate system is defined in FIGS. 1-4.

First Embodiment

A nozzle structure according to a first embodiment is described with reference to FIGS. 1 to 4.

Figure 1:
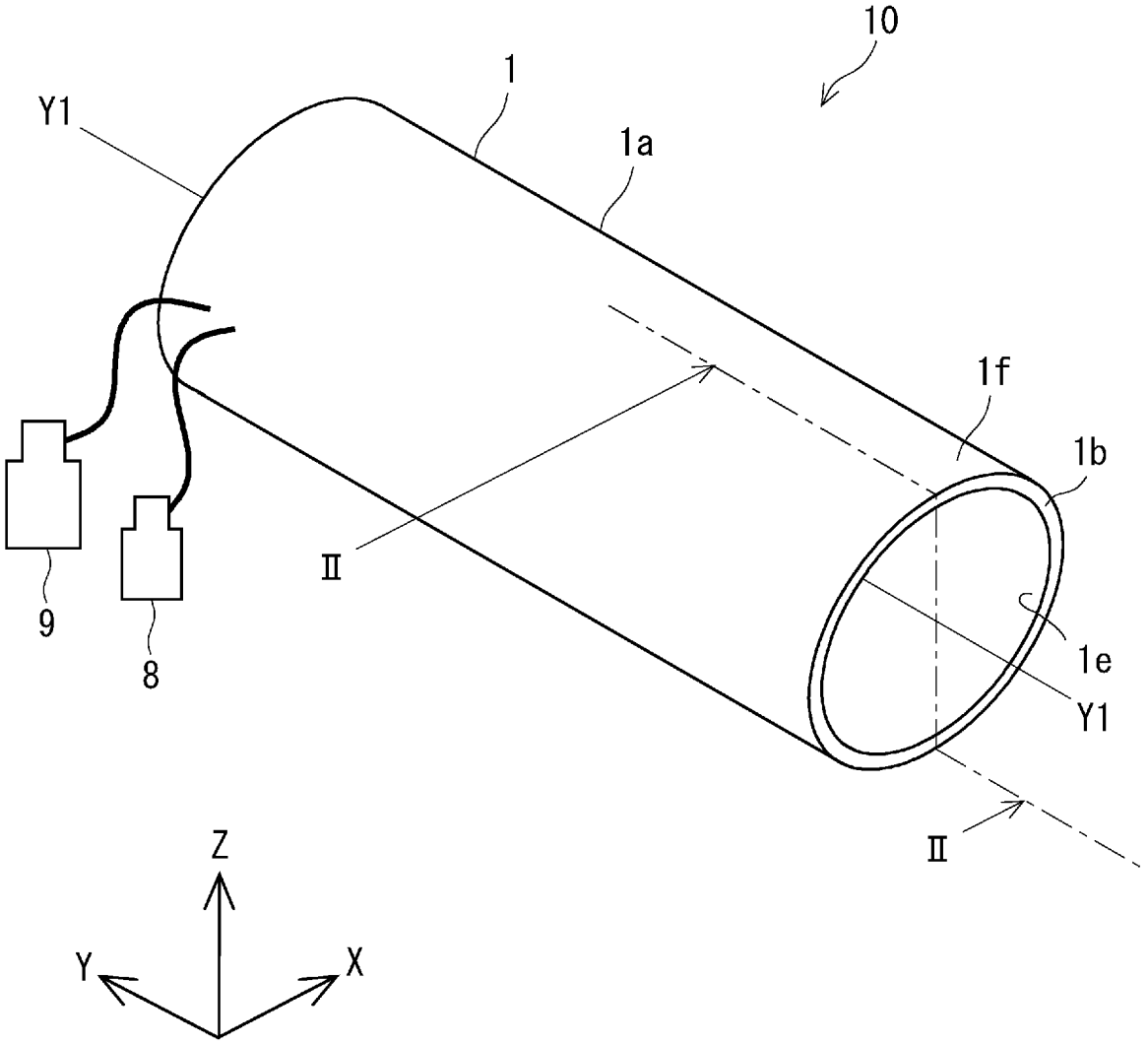
FIG. 1 is a perspective view showing a nozzle structure according to a first embodiment.
Figure 2:
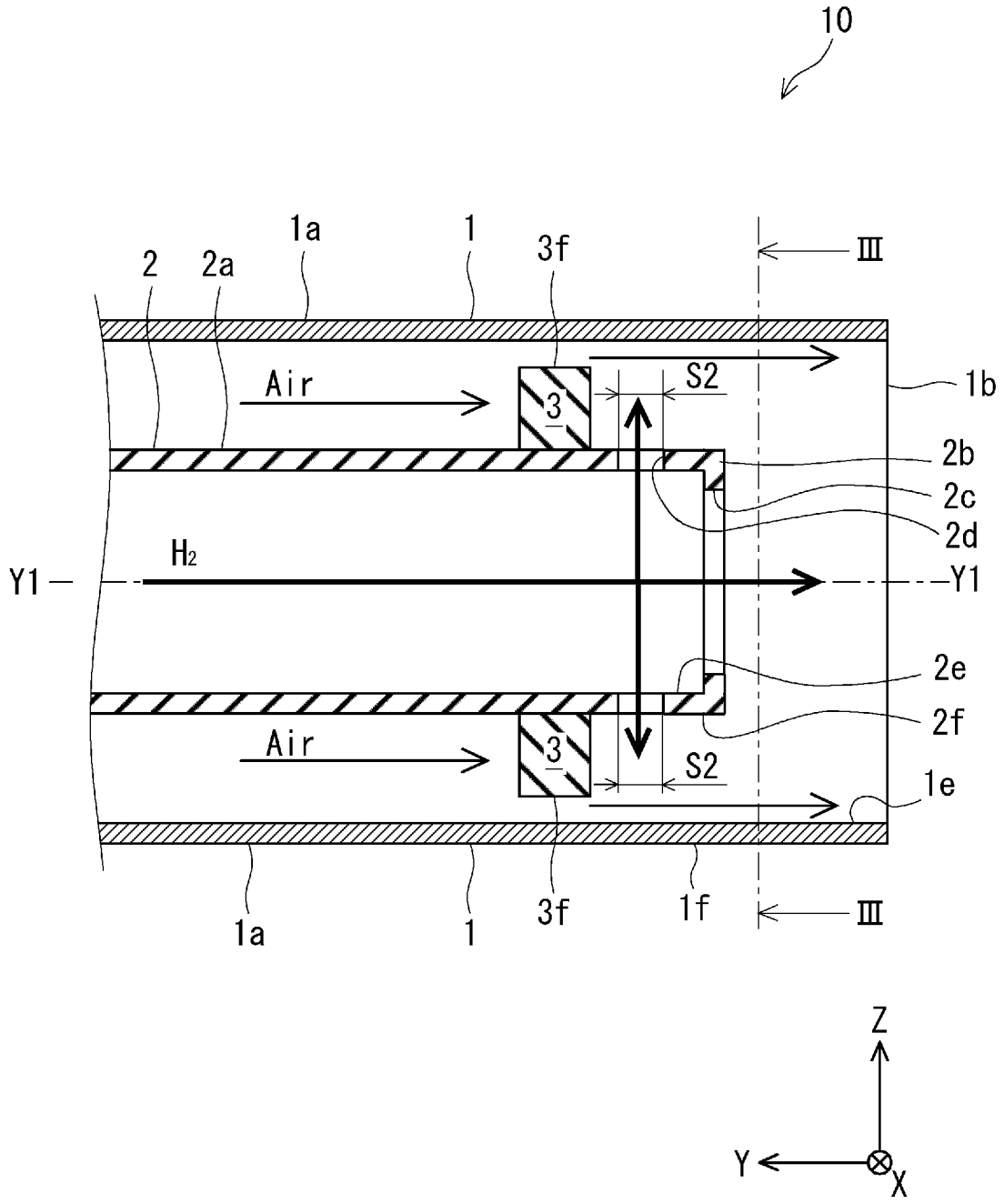
FIG. 2 is a cross section of a main part of the nozzle structure according to the first embodiment.

As shown in FIGS. 1 and 2, a nozzle structure 10 includes an outer pipe 1, an inner pipe 2, and a stabilizer 3. The nozzle structure 10 is used as a nozzle disposed in a hydrogen gas burner apparatus.

The outer pipe 1 includes a cylindrical body 1*a* having an imaginary axis Y1, and one end 1*b* of the cylindrical body 1*a* is opened. An oxygen-containing gas is supplied to the outer pipe 1 and it flows between the outer pipe 1 and the inner pipe 2. In the example shown in FIG. 1, air is used as the oxygen-containing gas. However, it is not limited to air and any gas containing oxygen may be used. Further, it is preferred that the oxygen-containing gas not contain a substantial amount of hydrogen. The oxygen-containing gas may be generated by using a manufacturing method including a process for removing hydrogen using a publicly-known method.

Figure 4:
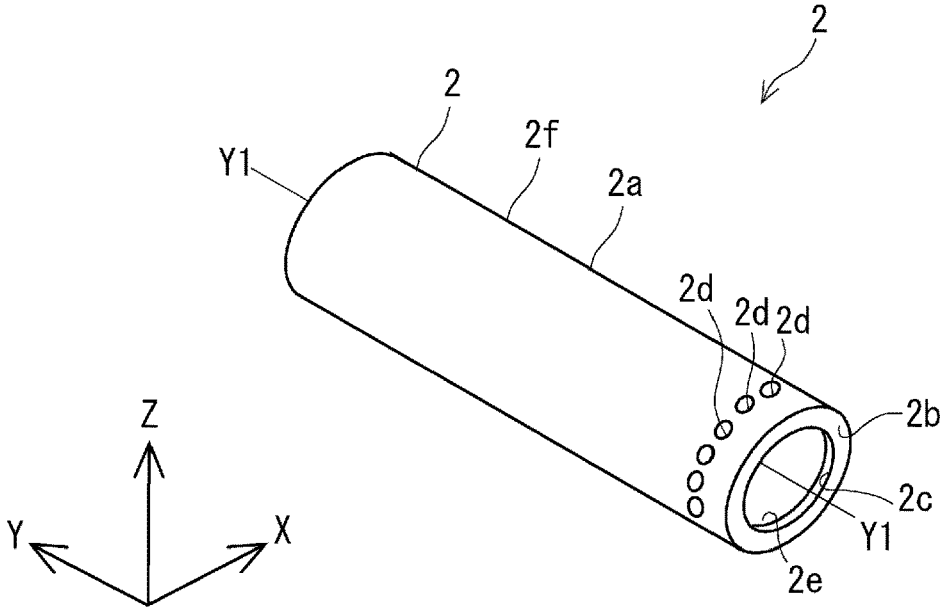
FIG. 4 is a perspective view of the main part of the nozzle structure according to the first embodiment.

As shown in FIGS. 2 and 4, the inner pipe 2 includes a cylindrical body 2*a*, and an inner-pipe end part 2*b*, which is one of the ends of the cylindrical body 2*a*, is opened. The inner pipe 2 is concentrically disposed inside the outer pipe 1. That is, the inner pipe 2 has the same axis Y1 as the outer pipe 1. The inner-pipe end part 2*b* has an axial opening hole 2*c* that penetrates (i.e., extends) along the axis Y1 of the inner pipe 2 and a circumferential opening hole(s) 2*d* that penetrates (i.e., extends) in a radial direction of the inner pipe 2.

In an example shown in FIG. 4, a plurality of circumferential opening holes 2*d* are formed on an outer circumferential surface 2*f* in the inner-pipe end part 2*b* of the inner pipe 2 in such a manner that they are arranged in a circumferential direction. In the example shown in FIG. 4, the plurality of circumferential opening holes 2*d* penetrate the inner-pipe end part 2*b* in a radial pattern around the axis Y1. In the example shown in FIG. 4, each of the circumferential opening holes 2*d* has a roughly circular shape. However, the shape of the circumferential opening holes 2*d* is not limited to the roughly circular shape. That is, they may have various shapes such as a slit-like shape.

A hydrogen gas is supplied to the inner pipe 2 and it flows through the inside of the inner pipe 2. The axial opening hole 2*c* lets the hydrogen gas flow out from the inner pipe 2 along the axis Y1 thereof. Further, the circumferential opening holes 2*d* let the hydrogen gas flow out from the inner pipe 2 in the radial direction thereof. Note that the radial direction of the inner pipe 2 is a direction from the axis Y1 toward the outer pipe 1 along a cross section that intersects the axis Y1 of the inner pipe 2 substantially at right angles.

Note that the example of the nozzle structure 10 shown in FIG. 1 further includes an air tank 8 and a hydrogen gas tank 9. As shown in FIGS. 1 and 2, air is supplied from the air tank 8 to a space between an inner circumferential surface 1*e* of the outer pipe 1 and an outer circumferential surface 2*f* of the inner pipe 2. Further, a hydrogen gas is supplied from the hydrogen gas tank 9 to the inside of the inner pipe 2. Note that although the example of the nozzle structure 10 shown in FIG. 1 includes the air tank 8, it may instead include a blower. Further, the nozzle structure 10 may include an apparatus for adjusting the amount and/or the flow rate of the supplied hydrogen gas, and/or the amount and/or the flow rate of the supplied oxygen-containing gas.

The stabilizer 3 is an annular member made of a material that blocks the oxygen-containing gas. The stabilizer 3 is preferably formed by substantially using one sheet-like material. Further, the stabilizer 3 may be provided with a vent(s) that is formed to let the oxygen-containing gas pass therethrough. However, the stabilizer 3 is preferably provided with no vent. Note that the stabilizer 3 may be provided with a hole, such as a window, for installing a spark plug and/or a detection device. The stabilizer 3 is disposed on the outer circumferential surface 2*f* of the inner pipe 2. The stabilizer 3 extends from the outer circumferential surface 2*f* of the inner pipe 2 toward the inner circumferential surface 1*e* of the outer pipe 1. Further, since the stabilizer 3 throttles (i.e., narrows) the space between the outer pipe 1 and the inner pipe 2, the space through which the oxygen-containing gas can pass becomes smaller. Note that the stabilizer 3 may be a cylindrical body and may cover substantially the entire area of the outer circumferential surface 2*f* of the inner pipe 2 between the inner-pipe end part 2*b* of the inner pipe 2 and a base-side end part thereof (i.e., on the positive side on the Y-axis in this example).

(Details of Nozzle Structure)

Figure 3:
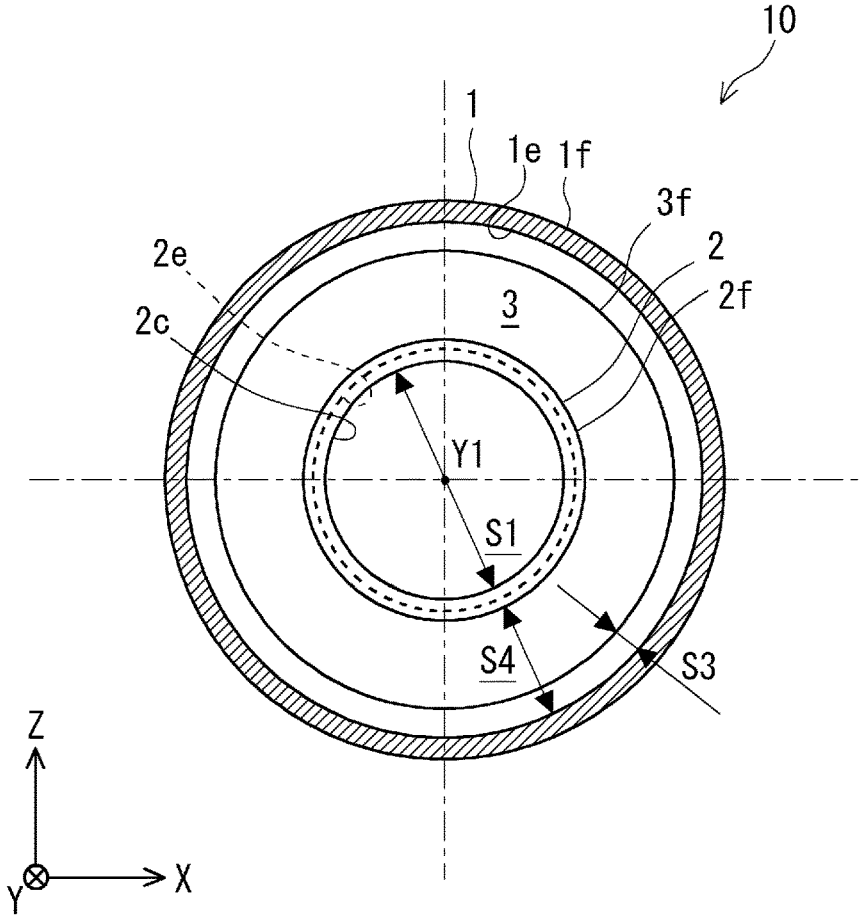
FIG. 3 is a cross section of the nozzle structure according to the first embodiment.

Next, the nozzle structure 10 is described in detail. As shown in FIGS. 3 and 4, a cross-sectional area S1 of the axial opening hole 2*c*, a cross-sectional area S2 of the circumferential opening holes 2*d*, a cross-sectional area S3 of the space between an outer edge 3*f* of the stabilizer 3 and the outer pipe 1, and a cross-sectional area S4 of the space between the inner and outer pipes 2 and 1 are defined. Specifically, as shown in FIG. 4, the cross-sectional area S1 is an area (i.e., a size) of a region surrounded by the opened end of the axial opening hole 2*c* on the cross section of the nozzle structure 10. The cross-sectional area S2 is a total cross-sectional area of the plurality of circumferential opening holes 2*d*. The cross-sectional area S3 is an area (i.e., a size) of a region surrounded by the outer edge 3*f* of the stabilizer 3 and the inner circumferential surface 1*e* of the outer pipe 1 on the cross section of the nozzle structure 10. The cross-sectional area S4 is an area (i.e., a size) of a region surrounded by the outer circumferential surface 2*f* of the inner pipe 2 and the inner circumferential surface 1*e* of the outer pipe 1 on the cross section of the nozzle structure 10.

A ratio S2/S1 [%] between the cross-sectional area S1 of the axial opening hole 2*c* and the cross-sectional area S2 of the circumferential opening holes 2*d* (also referred to as a hydrogen gas nozzle hole area ratio S2/S1) satisfies the below-shown Relational Expression 1.

$$S2/S1 \leq 50 \quad \text{(Relational Expression 1)}$$

Note that the area S2 may have any value larger than 0 (zero) % in order to stabilize a combustion flame. Further, it has also been experimentally confirmed that the combustion flame can be sufficiently stabilized when the ratio S2/S1 is 4.0% at the least.

A ratio S3/S4 [%] between the cross-sectional area S3 of the space between the outer edge 3*f* of the stabilizer 3 and the outer pipe 1 and the cross-sectional area S4 of the space between the inner and outer pipes 2 and 1 (also referred to as an air passage area ratio S3/S4) satisfies the below-shown Relational Expression 2.

$$S3/S4 \leq 45 \quad \text{(Relational Expression 2)}$$

Note that the area S3 may have any value larger than 0 (zero) %. This is for preventing combustion from abruptly occurring and thereby to prevent an excessively large pressure drop. Further, it has been experimentally confirmed that the pressure drop does not have any harmful effect that causes a practical problem in the nozzle structure for a hydrogen gas burner apparatus when the ratio S3/S4 is 10.0% at the least.

It is preferred that the above-shown Relational Expressions 1 and 2 be satisfied because when they are satisfied, the concentration of NOx (hereinafter referred to as the "NOx concentration") can be reduced to 20 ppm or lower under a predetermined condition. When the NOx concentration is equal to or lower than 20 ppm, it is lower than a regulation value for the NOx concentration for various environments and for various gas burner apparatuses. Therefore, even when the nozzle structure 10 is used under various environments and for various gas burner apparatuses, its NOx concentration can be lowered below the regulation value for the NOx concentration.

Further, the ratio S2/S1 and the ratio S3/S4 preferably satisfy the below-shown Relational Expression 3.

$$S3/S4 \leq 0.0179 \times (S2/S1)^2 - 1.7193 \times (S2/S1) + 45 \quad \text{(Relational Expression 3)}$$

When the above-shown Relational Expression 3 is satisfied, the NOx concentration can be reduced to 20 ppm or lower more reliably under a predetermined condition. Therefore, even when the nozzle structure 10 is used under various environments and for various gas burner apparatuses, its NOx concentration can be lowered below the regulation value for the NOx concentration more reliably.

(Combustion Flame Generation Method)

Next, a method of generating a combustion flame by the nozzle structure 10 by using air as the oxygen-containing gas is described.

As shown in FIG. 2, while a hydrogen gas is made to flow out from the circumferential opening holes 2*d* in the radial direction of the inner pipe 2, it is also made to flow out from the axial opening holes 2*c* in a direction along the axis Y1 of the inner pipe 2. Further, air is made to flow to the one end 1*b* of the outer pipe 1 through the other end 1*c* thereof. Regarding the condition for the combustion, the concentration of oxygen in the oxygen-containing gas is, for example, no lower than 10 mass % and no higher than 21 mass %. When air is used as the oxygen-containing gas, an air ratio is preferably, for example, 1.0 to 1.5, and more preferably 1.0 to 1.1. The other conditions for the combustion are, in principle, similar to those for a publicly-known nozzle structure for a gas burner apparatus using a hydrocarbon gas.

The hydrogen gas that has flowed out from the circumferential opening holes 2*d* proceeds along the stabilizer 3 and reaches the inner circumferential surface 1*e* of the outer pipe 1 or the periphery thereof. Meanwhile, after passing through the stabilizer 3, the air flows along the inner circumferential surface 1*e* of the outer pipe 1 and comes into contact with the hydrogen gas that has flowed out from the circumferential opening holes 2*d*. The air and the hydrogen gas flow toward the one end 1*b* of the outer pipe 1. Then, they pass through the one end 1*b* and are discharged to the outside of the outer pipe 1. A small part of the hydrogen gas and a small part of the oxygen in the air react with each other in the section between the stabilizer 3 and the one end 1*b* of the outer pipe 1. The reactant of this reaction between the hydrogen gas and the oxygen joins a combustion flame (which will be described later).

Meanwhile, the hydrogen gas that has flowed out from the axial opening hole 2*c* flows to the one end 1*b* of the outer pipe 1 and is discharged to the outside of the outer pipe 1. By using an ignition apparatus such as a spark plug (not shown) disposed near the one end 1*b* of the outer pipe 1, a spark or the like is generated and the hydrogen gas is ignited and burned. As a result, a combustion flame can be generated from the one end 1*b* of the outer pipe 1 of the nozzle structure 10. The reactant of the above-described reaction between the hydrogen gas and the oxygen in the air joins the combustion flame and hence the combustion flame can be stabilized. Therefore, the area S2 may have any value larger than 0 (zero) %.

EXAMPLES

Next, experiments in which amounts of generated NOx were measured for examples of the nozzle structure 10 and for their comparative examples are explained with reference to FIGS. 5 and 6.

In the experiments, NOx concentrations in the examples of the nozzle structure 10 were compared to those in the comparative examples on the condition that a combustion amount was adjusted to 20%. Regarding the condition for the experiments, the air ratio was adjusted to 1.1 to 1.2. Air was used as the oxygen-containing gas. The oxygen concentration was 21%. The other conditions for the combustion are, in principle, similar to those for a publicly-known nozzle structure using a hydrocarbon gas. In the comparative examples, a nozzle structure having the same structure as that of the nozzle structure 10 except that it has at least one of the following features: its ratio S2/S1 is higher than 50%; and its ratio S3/S4 is higher than 45%, was used. Note that when the ratio S3/S4 is 100%, it means that the nozzle structure according to the comparative examples does not have any structure corresponding to the stabilizer 3. Each of the stabilizers of the nozzle structures according to Examples 1, 2, 4, and 5 has no vent through which air can flow. The stabilizer of the nozzle structure according to Example 3 has a vent(s) through which air can flow.

Table 1 shows results of measurement of NOx concentrations for the examples of the nozzle structure 10 and for the comparative examples.

TABLE 1

| Sample Number | Stabilizer Used/ Not used | Stabilizer Vent | S2/S1 [%] | S3/S4 [%] | NO*x* Concentration [ppm] |
|---|---|---|---|---|---|
| Comparative Example 1 | Not used | — | 100 | 100 | 100 |
| Comparative Example 2 | Not used | — | 50 | 100 | 75.6 |
| Comparative Example 3 | Not used | — | 15 | 100 | 48.1 |
| Comparative Example 4 | Not used | — | 7 | 100 | 43.4 |
| Comparative Example 5 | Not used | — | 4 | 100 | 36.0 |
| Example 1 | Used | Not formed | 4 | 28 | 21.8 |
| Example 2 | Used | Not formed | 4 | 14 | 18.1 |
| Example 3 | Used | Formed | 4 | 29 | 29.5 |
| Example 4 | Used | Not formed | 0 | 28 | 14.2 |
| Example 5 | Used | Not formed | 4 | 10 | 13.6 |

Figure 5:
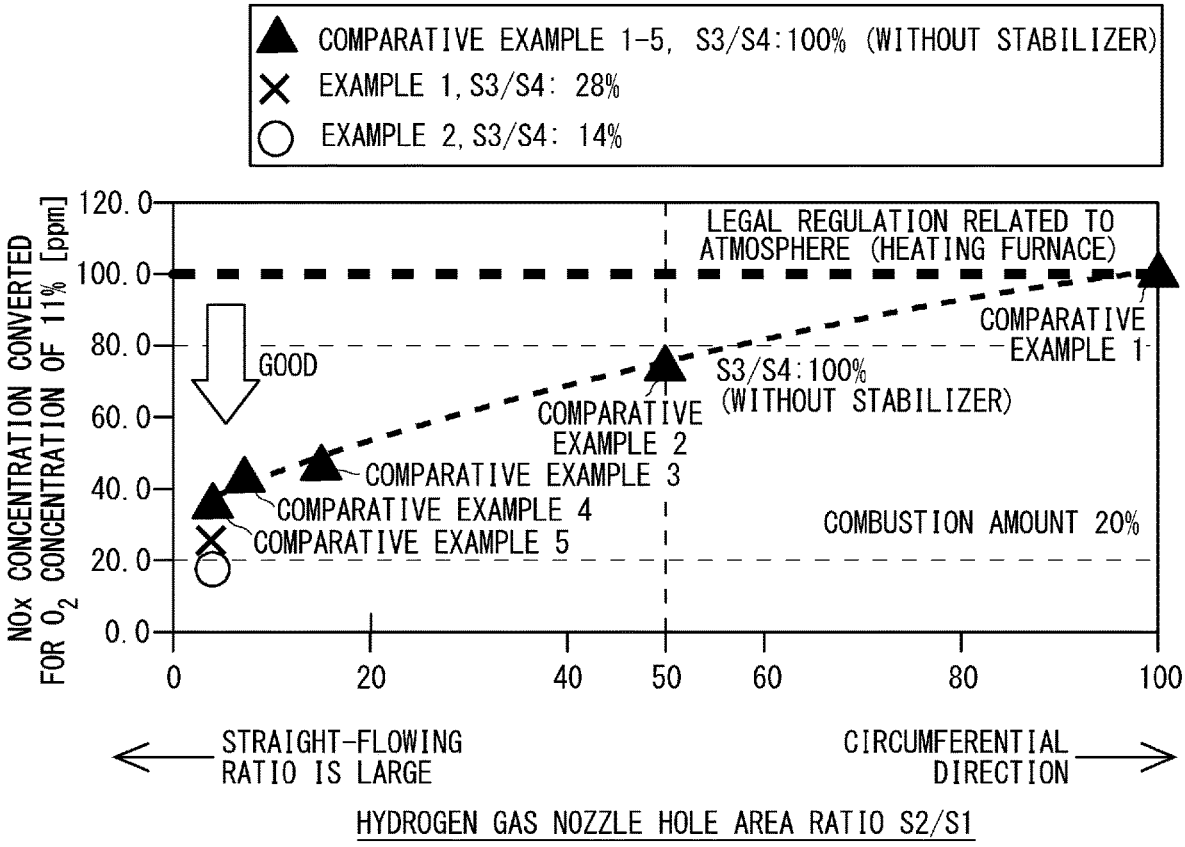
FIG. 5 is a graph showing converted NOx concentrations for an $O_2$ concentration of 11% for a hydrogen gas nozzle hole area ratio S2/S1.
Figure 6:
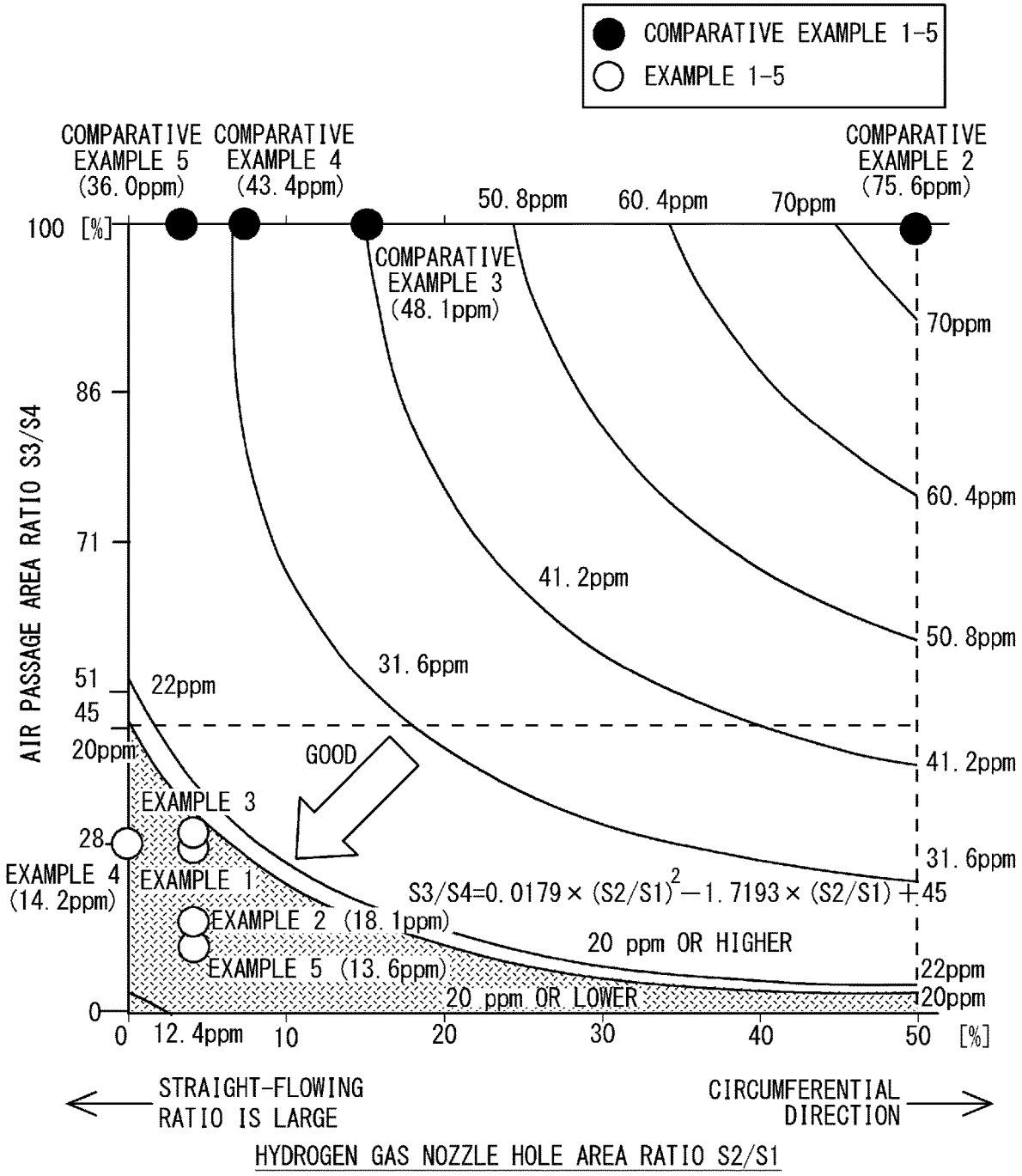
FIG. 6 is a contour graph showing a conversion of NOx concentrations for an $O_2$ concentration of 11% for a hydrogen gas nozzle hole area ratio S2/S1 and an air passage area ratio S3/S4.

FIG. 5 shows NOx concentrations versus ratios S2/S1. As shown in FIG. 5, when the ratio S2/S1 is low, the NOx concentration tends to be low. It is considered that one reason for this tendency is that when the ratio S2/S1 is low, a straight-flowing property of the hydrogen gas in the axial direction of the inner pipe 2 increases and hence the hydrogen gas is less likely to mix with the air. Specifically, when the ratio S2/S1 is low, the ratio of the cross-sectional area S2 of the circumferential opening holes 2*d* to the cross-sectional area S1 of the axial opening hole 2*c* is low. Therefore, the amount of the hydrogen gas that flows from the axial opening hole 2*c* in the axial direction of the inner pipe 2 tends to increase compared to the amount of the hydrogen gas that flows from the circumferential opening holes 2*d* in the radial direction of the inner pipe 2. Therefore, the hydrogen gas flows in such a manner that it proceeds straight in the axial direction of the inner pipe 2, i.e., along the axial direction of the nozzle structure 10.

As shown in FIG. 5, when the ratio S2/S1 was equal to or lower than 50%, the NOx concentration was equal to or lower than 80 ppm. It is preferred that the NOx concentration be equal to or lower than 80 ppm because when the NOx concentration is equal to or lower than 80 ppm, it is lower than the regulation value for the NOx concentration for ordinary environments and for ordinary apparatuses. Therefore, it has been determined that the ratio S2/S1 [%] between the cross-sectional area S1 of the axial opening hole 2*c* and the cross-sectional area S2 of the circumferential opening holes 2*d* should satisfy the below-shown Relational Expression 1.

$$S2/S1 \leq 50 \quad \text{(Relational Expression 1)}$$

Next, the NOx concentration was measured while changing the ratio S3/S4 within a predetermined range on the condition that the ratio S2/S1 was within a range higher than 0% and no higher than 50%. FIG. 6 shows results of the measurement. As shown in FIG. 6, when the ratio S3/S4 is reduced, the amount of generated NOx tends to decrease. When the ratio S3/S4 is equal to or lower than 45%, the NOx concentration can be 20 ppm or lower under a predetermined condition. It is preferred that the NOx concentration be equal to or lower than 20 ppm because when the NOx concentration is equal to or lower than 20 ppm, it is lower than the regulation value for the NOx concentration for ordinary environments and for ordinary apparatuses.

The NOx concentration in Example 1 was lower than that in Example 3. One conceivable reason for this phenomenon is as follows. That is, while the stabilizer of the nozzle structure according to Example 3 has a vent(s), the stabilizer of the nozzle structure according to Example 1 has no vent. As a result, compared to Example 3, the air and the hydrogen gas are less likely to mix with each other in Example 1.

Next, FIG. 5 shows a contour graph showing NOx concentrations versus ratios S2/S1 and ratios S3/S4. The more the ratio S3/S4 decreases, the more the amount of generated NOx decreases. It is considered that one reason for this tendency is that when the ratio S3/S4 decreases, the flow rate of the air decreases and hence the amount of the air that is mixed with the hydrogen gas decreases. Further, as another reason, it is considered that when the ratio S3/S4 decreases, the air flows through places that are further away from the hydrogen gas and hence the hydrogen gas is less likely to mix with the air.

Next, Expression 1 (Relational Expression 3) representing a response surface in which the NOx concentration is 20 ppm was obtained by using a statistical quality control method. Specifically, for measurement results shown in the below-shown Table 2, an expression representing a response surface for the NOx concentration of 20 ppm was obtained by optimizing a plurality of characteristics by using a response surface methodology for an experimental design for a statistical quality control method. Note that "StatWorks" (Registered Trademark) was used as statistical analysis software. Further, a characteristic value was the "NOx concentration". Factors other than the "NOx concentration", i.e., "S2/S1", "S3/S4", "NOx concentration", "furnace temperature", "air ratio", "furnace $O_2$ air ratio", and "combustion amount" were used as variables.

TABLE 2

| Sample Number — | S2/S1 [%] | S3/S4 [%] | NOx Concentration [ppm] | Furnace temperature [° C.] | Air ratio — | Furnace $O_2$ air radio — | Combustion amount [%] |
|---|---|---|---|---|---|---|---|
| Example 6 | 0 | 14 | 25.0 | 789.7 | 1.33 | 1.12 | 20 |
| Example 7 | 0 | 14 | 19.1 | 872.3 | 1.18 | 1.15 | 50 |
| Example 8 | 0 | 14 | 14.2 | 911.0 | 1.18 | 1.11 | 90 |
| Example 9 | 0 | 28 | 19.3 | 740.7 | 1.15 | 1.12 | 20 |
| Example 10 | 0 | 28 | 18.7 | 814.0 | 1.15 | 1.15 | 50 |
| Example 11 | 0 | 28 | 14.2 | 859.7 | 1.17 | 1.11 | 90 |
| Example 12 | 4 | 14 | 18.1 | 611.0 | 1.18 | 1.12 | 20 |
| Example 13 | 4 | 14 | 15.0 | 717.3 | 1.14 | 1.12 | 50 |
| Example 14 | 4 | 14 | 11.6 | 788.0 | 1.14 | 1.11 | 90 |
| Example 15 | 4 | 28 | 21.8 | 736.3 | 1.18 | 1.09 | 20 |
| Example 16 | 4 | 28 | 21.7 | 842.0 | 1.17 | 1.14 | 50 |
| Example 17 | 4 | 28 | 15.8 | 896.0 | 1.15 | 1.11 | 90 |
| Comparative Example 6 | 4 | 100 | 36.0 | 712.7 | 0.94 | 1.22 | 20 |
| Comparative Example 7 | 4 | 100 | 24.1 | 796.7 | 1.10 | 1.21 | 50 |
| Comparative Example 8 | 4 | 100 | 20.0 | 856.7 | 1.09 | 1.20 | 90 |
| Example 18 | 7 | 14 | 18.0 | 677.7 | 1.27 | 1.15 | 20 |
| Example 19 | 7 | 14 | 15.2 | 772.7 | 1.18 | 1.14 | 50 |
| Example 20 | 7 | 14 | 11.4 | 830.0 | 1.12 | 1.09 | 90 |
| Example 21 | 7 | 28 | 21.9 | 716.3 | 1.16 | 1.15 | 20 |
| Example 22 | 7 | 28 | 18.6 | 816.3 | 1.16 | 1.15 | 50 |
| Example 23 | 7 | 28 | 13.5 | 867.0 | 1.18 | 1.09 | 90 |
| Comparative Example 9 | 7 | 100 | 43.4 | 621.3 | 0.97 | 1.15 | 20 |
| Comparative Example 10 | 7 | 100 | 25.7 | 692.3 | 1.13 | 1.12 | 50 |
| Comparative Example 11 | 7 | 100 | 19.2 | 757.0 | 1.12 | 1.22 | 90 |
| Example 24 | 15 | 14 | 19.1 | 652.7 | 1.26 | 1.15 | 20 |
| Example 25 | 15 | 14 | 15.8 | 749.0 | 1.17 | 1.14 | 50 |
| Example 26 | 15 | 14 | 12.2 | 815.3 | 1.14 | 1.11 | 90 |
| Example 27 | 15 | 28 | 20.1 | 723.7 | 1.15 | 1.11 | 20 |
| Example 28 | 15 | 28 | 19.7 | 818.0 | 1.16 | 1.15 | 50 |
| Example 29 | 15 | 28 | 15.8 | 860.3 | 1.21 | 1.11 | 90 |
| Comparative Example 12 | 15 | 100 | 48.1 | 662.3 | 0.94 | 1.16 | 20 |
| Comparative Example 13 | 15 | 100 | 34.4 | 738.7 | 1.13 | 1.17 | 50 |
| Comparative Example 14 | 15 | 100 | 22.5 | 823.7 | 1.12 | 1.18 | 90 |
| Comparative Example 15 | 50 | 100 | 75.6 | 560.0 | 1.13 | 1.09 | 20 |
| Comparative Example 16 | 50 | 100 | 46.5 | 656.7 | 1.10 | 1.12 | 50 |
| Comparative Example 17 | 50 | 100 | 32.8 | 753.3 | 1.14 | 1.13 | 90 |
| Comparative Example 18 | 100 | 100 | 101.7 | 699.0 | 0.96 | 1.17 | 20 |
| Comparative Example 19 | 100 | 100 | 60.3 | 809.3 | 1.22 | 1.17 | 50 |
| Comparative Example 20 | 100 | 100 | 43.5 | 867.3 | 1.16 | 1.13 | 90 |

Similarly, for each of cases where the NOx concentration was 70, 60.4, 50.8, 41.2, 31.6, 22, and 12.4 ppm, respectively, an expression representing a response surface was obtained. FIG. 6 shows curves obtained according to the obtained expressions for the response surfaces. Note that Examples 6 to 29 and Comparative Examples 6 to 20 shown in Table 2 were obtained by experiments. Therefore, it should be noted that measured values of the NOx concentration include variations and hence they do not necessarily coincide with the contour graph shown in FIG. 6.

An expression (Relational Expression 3) representing a response surface in which the amount of generated NOx is 20 ppm is shown below.

$$S3/S4 \leq 0.0179 \times (S2/S1)^2 - 1.7193 \times (S2/S1) + 45 \quad \text{(Relational Expression 3)}$$

It is preferred that the above-shown relational expression be satisfied because when the above-shown relational expression is satisfied, the calculation result of the NOx concentration can be reliably lowered to 20 ppm or lower.

Based on Relational Expression 3, when the ratio S3/S4 is equal to or lower than 45%, the NOx concentration can be 20 ppm or lower. Therefore, it has been determined that the ratio S3/S4 [%] between the cross-sectional area S3 of the space between the stabilizer 3 and the inner circumferential surface 1*e* of the outer pipe 1 and the cross-sectional area S4 of the space between the outer circumferential surface 2*f* of the inner pipe 2 and the inner circumferential surface 1*e* of the outer pipe 1 should satisfy the below-shown Relational Expression 2.

$$S3/S4 \leq 45 \quad \text{(Relational Expression 2)}$$

Application Example

Next, application examples of the nozzle structure 10 for a hydrogen gas burner apparatus are described with reference to FIGS. 7 and 8.

Figure 7:
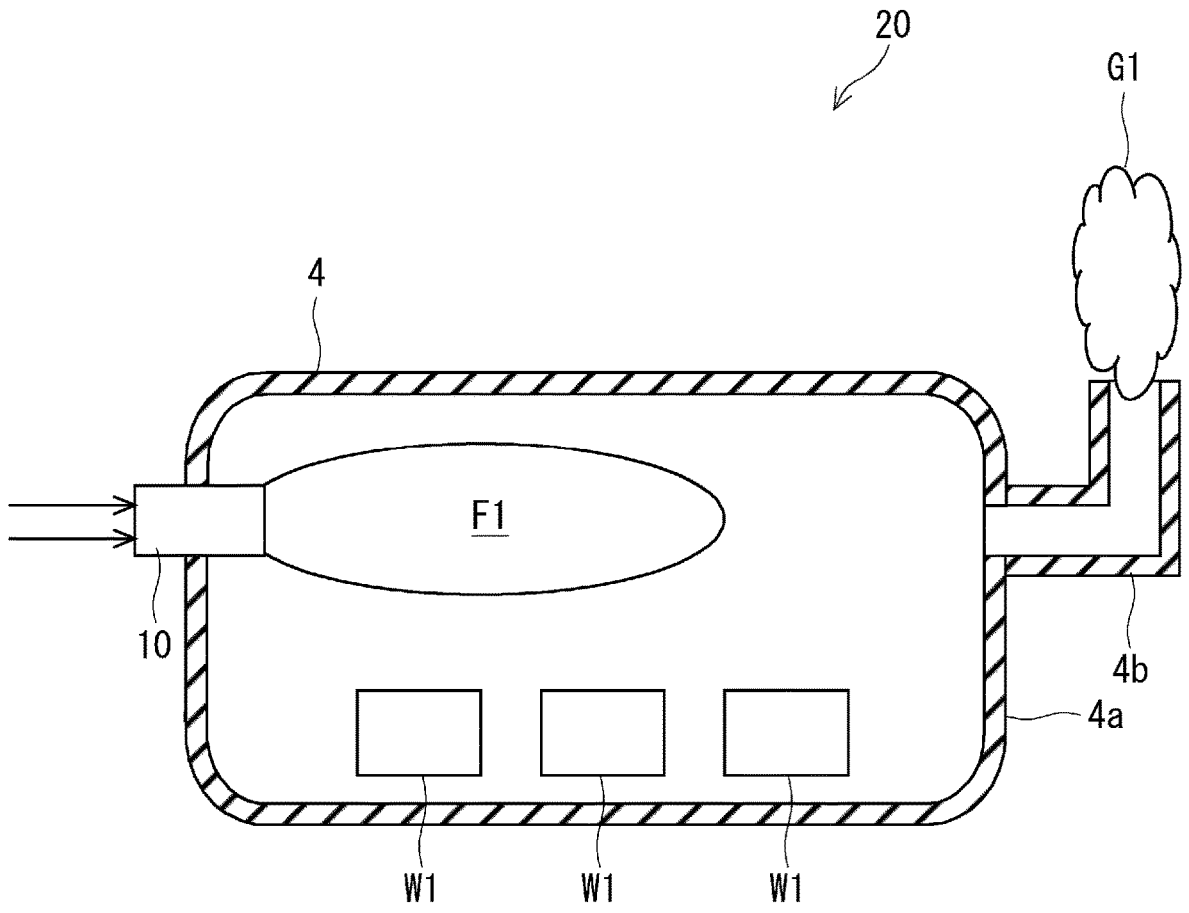
FIG. 7 is a schematic cross section showing an application example of the nozzle structure according to the first embodiment.

As shown in FIG. 7, the nozzle structure 10 for a hydrogen gas burner apparatus can be used as a component of a furnace 20 equipped with a burner apparatus. The furnace 20 with the burner apparatus includes a furnace body 4 and a nozzle structure 10. The furnace body 4 includes a main body 4*a* and an exhaust pipe 4*b*. The main body 4*a* has a box-like shape and holds (i.e., stores) workpieces W1. The exhaust pipe 4*b* is disposed in an upper part of the main body 4*a* and guides an exhaust gas G1 generated inside the main body 4*a* to the outside of the main body 4*a*. The nozzle structure 10 is disposed in the main body 4*a* in such a manner that a combustion flame F1 generated by the nozzle structure 10 is formed toward the inside of the main body 4*a*. The nozzle structure 10 may be disposed in a place a predetermined distance away from the exhaust pipe 4*b*.

Note that when the nozzle structure 10 generates a combustion flame F1, it can heat the workpieces W1 mainly through convection and thermal conduction. Similarly to a publicly-known furnace with a burner apparatus using a hydrocarbon gas as a fuel gas, the furnace 20 with the burner apparatus can heat-treat the workpieces W1 made of various materials by using various heat-treating methods. For example, the workpieces W1 may be made of a metallic material such as an aluminum alloy or steel, or a ceramics material. Note that an exhaust gas G1 generated by the combustion flame F1 passes through the exhaust pipe 4*b* and is discharged to the outside of the main body 4*a*.

Figure 8:
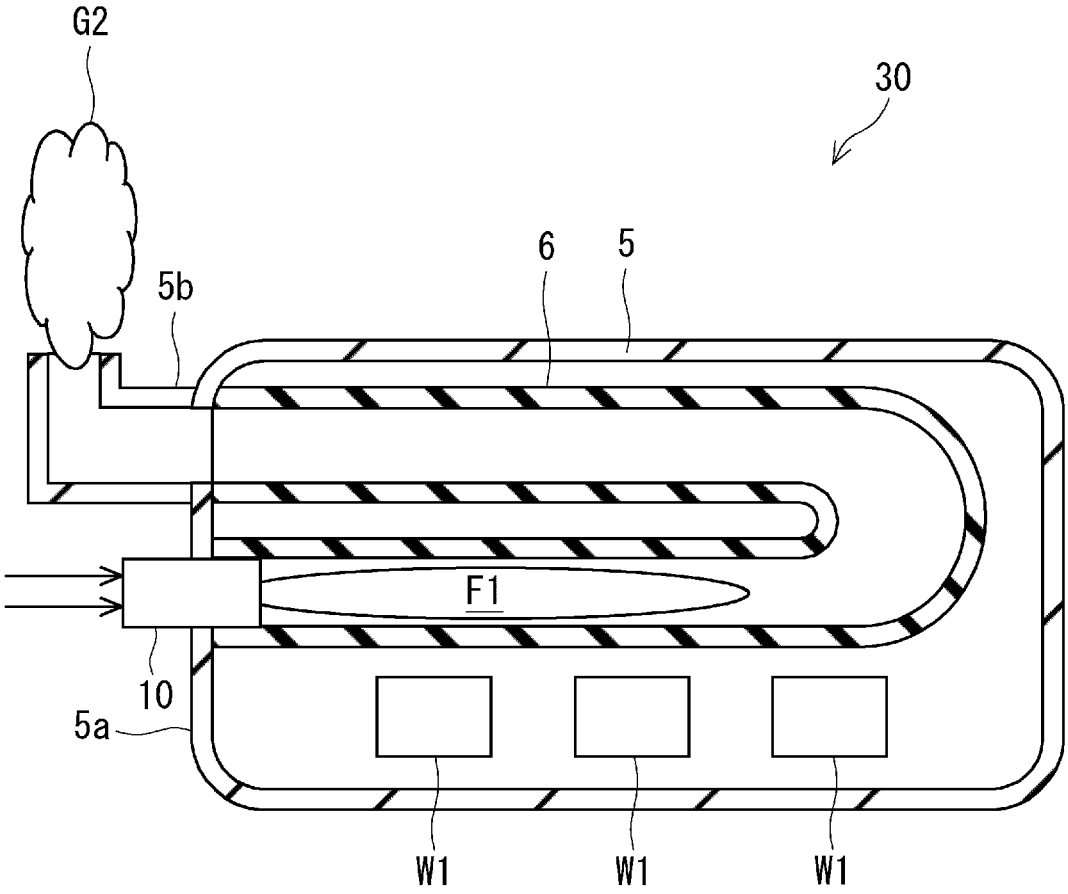
FIG. 8 is a schematic cross section showing another application example of the nozzle structure according to the first embodiment.

As shown in FIG. 8, the nozzle structure 10 for the hydrogen gas burner apparatus can be used as a component of a furnace 30 equipped with a radiant tube burner apparatus. The furnace 30 with the radiant tube burner apparatus includes a furnace body 5, a radiant tube 6, and a nozzle structure 10. The furnace body 5 includes a main body 5*a* and an exhaust pipe 5*b*. The main body 5*a* has a box-like shape and holds (i.e., stores) workpieces W1. The exhaust pipe 5*b* is disposed in an upper part of the main body 5*a* and guides an exhaust gas G2 generated inside the radiant tube 6 to the outside of the main body 5*a*. The nozzle structure 10 is disposed in the main body 5*a* in such a manner that a combustion flame F1 generated by the nozzle structure 10 is formed toward the inside of the main body 5*a*. The radiant tube 6 is disposed so as to connect the nozzle structure 10 to the exhaust pipe 5*b*. The combustion flame F1 generated by the nozzle structure 10 is formed inside the radiant tube 6. The nozzle structure 10 is preferably disposed in a place a predetermined distance away from the exhaust pipe 5*b*.

Note that when the nozzle structure 10 generates a combustion flame F1, the radiant tube 6 is first heated and thereby generates radiant heat. The workpieces W1 can be heated mainly by this radiant heat. Similarly to a publicly-known furnace with a radiant tube burner apparatus using a hydrocarbon gas as a fuel gas, the furnace 30 with the radiant tube burner apparatus can heat-treat the workpieces W1 made of various materials by using various heat-treating methods. For example, the workpieces W1 may be made of a metallic material such as an aluminum alloy or steel, or a ceramics material. An exhaust gas G2 generated by the combustion flame F1 passes through the radiant tube 6 and the exhaust pipe 5*b*, and is discharged to the outside of the main body 5*a*.

Note that the present disclosure is not limited to the above-described embodiments and they can be modified as desired without departing from the spirit of the present disclosure. For example, although the nozzle structure 10 includes the stabilizer 3 in the above-described embodiment, it may include a control valve.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A nozzle structure for a hydrogen gas burner apparatus, comprising an outer pipe, an inner pipe disposed concentrically with the outer pipe, and a stabilizer configured to throttle a space between the outer pipe and the inner pipe, wherein the inner pipe comprises an inner pipe end part with an axial opening hole and a circumferential opening hole formed therein, the axial opening hole penetrating in an axial direction of the inner pipe, the circumferential opening hole penetrating in a radial direction of the inner pipe, a hydrogen gas flows through the inner pipe, the circumferential opening hole lets the hydrogen gas flow out from the inner pipe in the radial direction of the inner pipe, the axial opening hole lets hydrogen gas flow out from the inner pipe in the axial direction of the inner pipe, an oxygen-containing gas flows between the outer pipe and the stabilizer, a ratio S2/S1 between a cross-sectional area S1 of the axial opening hole and a cross-sectional area S2 of the circumferential opening hole is equal to or lower than 50%, and a ratio S3/S4 between a cross-sectional area S4 of a space between the inner pipe and the outer pipe and a cross-sectional area S3 of a space between an outer edge of the stabilizer and the outer pipe is equal to or lower than 45%.

2. The nozzle structure for a hydrogen gas burner apparatus according to claim 1, wherein the ratio S2/S1 and the ratio S3/S4 satisfy the following relation:

$$S3/S4 \leq 0.0179 \times (S2/S1)^2 - 1.7193 \times (S2/S1) + 45.$$

* * * * *